US006810931B2

(12) United States Patent
Graffin

(10) Patent No.: US 6,810,931 B2
(45) Date of Patent: Nov. 2, 2004

(54) ELECTROMAGNETICALLY-CONTROLLED FILLER SPOUT

(75) Inventor: André Graffin, Kuala Lumpur (MY)

(73) Assignee: Serac Group, La Ferte Bernard (FR)

( * ) Notice: Subject to any disclaimer, the term of this patent is extended or adjusted under 35 U.S.C. 154(b) by 0 days.

(21) Appl. No.: 10/413,215

(22) Filed: Apr. 15, 2003

(65) Prior Publication Data

US 2003/0196721 A1 Oct. 23, 2003

(30) Foreign Application Priority Data

Apr. 22, 2002 (FR) ..... 02 04987

(51) Int. Cl.[7] ..... B65B 1/00

(52) U.S. Cl. ..... 141/301; 141/302; 141/305; 141/367; 141/387; 141/DIG. 1; 251/84; 251/129.21

(58) Field of Search ..... 141/301, 302, 141/305, 367, 368, 387, DIG. 1; 251/84, 86, 129.21; 222/504, 509

(56) References Cited

U.S. PATENT DOCUMENTS

| | | | | |
|---|---|---|---|---|
| 3,604,480 A | * | 9/1971 | Reichert et al. | 141/39 |
| 5,209,455 A | * | 5/1993 | Uetsuhara et al. | 251/129.19 |
| 5,474,107 A | * | 12/1995 | Hayes | 137/625.5 |
| 5,769,136 A | * | 6/1998 | Kanematsu et al. | 141/129 |

FOREIGN PATENT DOCUMENTS

| | | |
|---|---|---|
| EP | 0 775 635 | 5/1997 |
| GB | 2 086 861 | 5/1982 |

* cited by examiner

*Primary Examiner*—Gregory L. Huson
*Assistant Examiner*—Peter deVore
(74) *Attorney, Agent, or Firm*—Young & Thompson

(57) ABSTRACT

The filler spout comprises a tubular body having mounted therein a valve member and a magnetic actuator element connected to the valve member via a coupling member comprising two elements that are coupled to each other via a coupling that includes radial clearance.

6 Claims, 2 Drawing Sheets

ELECTROMAGNETICALLY-CONTROLLED FILLER SPOUT

The present invention relates to an electromagnetically-controlled filler spout.

BACKGROUND OF THE INVENTION

A filler spout known in particular from document WO 01/40098 comprises a tubular body having mounted therein a valve member extending over a valve seat, and a magnetic actuator element associated with a coil outside the tubular body and connected to the valve member via an axial coupling member. The assembly formed in this way is radially rigid so that in order to ensure that the valve member is accurately positioned relative to the valve seat in order to obtain satisfactory leaktightness, it is necessary not only for the valve member to be guided accurately along the axis of the valve seat, but also for the magnetic actuator element to be guided in very precise manner along the axis of the valve member, thereby leading to very significant manufacturing constraints. In particular, the valve member and the magnetic actuator element need to be mounted accurately on the same axis as each other, and when the body of the filler spout is made up of a plurality of assembled-together elements, it is necessary for the elements of the body to be mounted relative to one another in a manner that ensures they are accurately on the same axis. These constraints lead to high manufacturing cost for the filler spout.

OBJECTS AND SUMMARY OF THE INVENTION

A first object of the invention is to propose a filler spout that operates in satisfactory manner while being less expensive to manufacture than prior filler spouts.

A second object of the invention is to propose a filler spout that can easily be adapted to different substances.

In accordance with the first object of the invention, a filler spout is proposed of the above-specified type in which the coupling member comprises two elements coupled together via a coupling that includes radial clearance. The control function exerted by the magnetic actuator element is thus dissociated from the closing function performed by the valve member, such that the various elements making up the filler spout can be made separately and assembled together in a configuration in which they do not lie accurately on the same axis, without the operation of the filler spout suffering as a result.

In an advantageous version of the invention, the valve member and the magnetic actuator element are mounted in separate-body elements connected together by a quick coupling member, and the elements of the coupling member are separable. It is thus possible to make up different control member and shutter member combinations quickly.

According to an advantageous aspect of this version of the invention, one of the elements of the coupling member is a C-shaped yoke, and the other element is a peg having a head engaged between branches of the yoke. After opening the quick coupling member, it is thus possible to separate the valve member and the magnetic actuator element merely by shifting them sideways relative to each other.

In another advantageous aspect of the invention, the filler spout includes a secondary shutter disposed downstream from the valve member and rigidly connected thereto, and the body has a constriction overlying the secondary shutter, the secondary shutter and the constriction being of dimensions and relative positioning that are appropriate to ensure that while the valve member is closed, the secondary shutter leaves clearance relative to the constriction that is just sufficient to retain a liquid contained in the body between the valve member and the secondary shutter by means of capillarity. This makes it possible without interfering with the closure action of the valve member to maintain a quantity of substance in the filler spout which is sufficient to avoid faulty formation of the jet of substance when the valve member is opened.

BRIEF DESCRIPTION OF THE DRAWINGS

Other characteristics and advantages of the invention appear further on reading the following description of a particular embodiment of the invention and of different variants thereof, given with reference to the accompanying figures, in which.

MORE DETAILED DESCRIPTION

Figure 1:
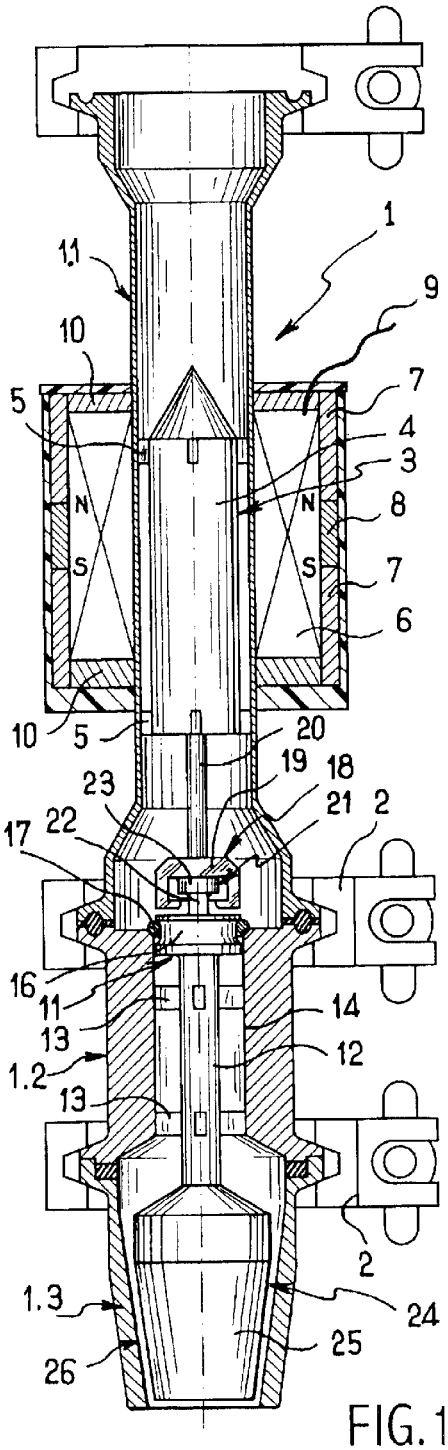
FIG. 1 is an axial section view of a filler spout of the invention in a valve-closed position.
Figure 2:
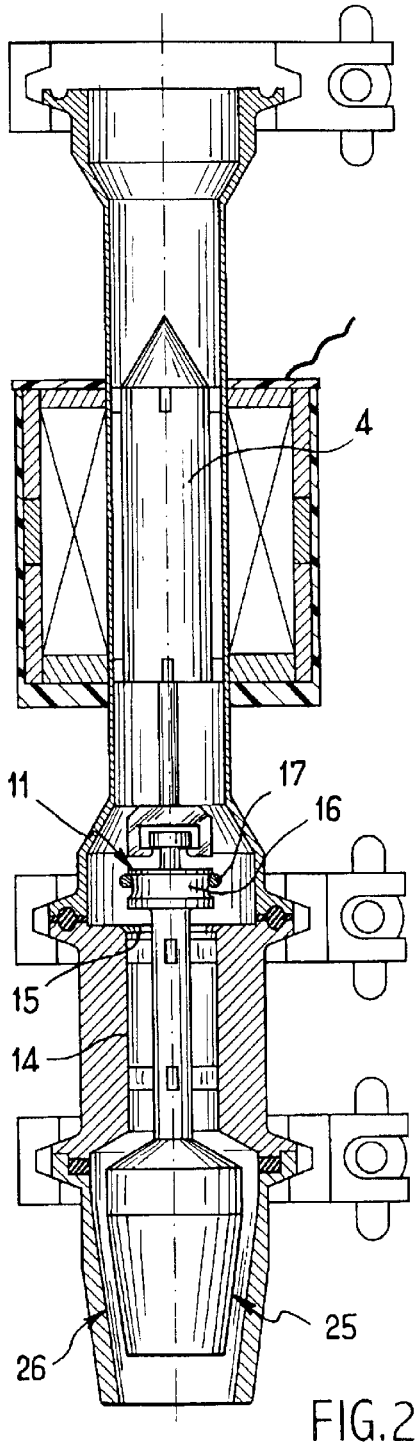
FIG. 2 is a view analogous to that of FIG. 1, in a valve-open position.

With reference to FIGS. 1 and 2, the filler spout of the invention comprises a tubular body 1 made up of three body elements 1.1, 1.2, and 1.3 interconnected by quick coupling members 2 and respectively containing the elements performing the control, shut-off, and outlet delivery or secondary shut-off functions of the filler spout of the invention.

The control function is performed by a magnetic actuator element 3 mounted to slide in body element 1.1. In the embodiment of FIG. 1, the magnetic actuator element 3 comprises a solid magnetic core 4 provided at its periphery with guide fins 5 which provide accurate guidance for the core 4 inside the body element 1.1 while allowing a substance to flow between the core 4 and the inside face of the body element 1.1. The body element 1.1 is made of non-magnetic material, and it is surrounded by a coil 6 connected by a feed wire 9 to power supply means (not shown) for forming an electromagnetic actuator device.

In the embodiment shown, the coil 6 is also surrounded by rings of magnetic material 7 surrounding a ring 8 forming a permanent magnet, e.g. a ring of ferrite whose permanent magnetic field extends in an axial direction of the coil 6. At its ends, the coil 6 is also covered by plates of magnetic material 10 having their peripheries in contact with the rings 7. The ferrite ring 8 is preferably dimensioned to exert a force on the magnetic actuator element 3 that is nearly equal to the weight of said element and of the equipment associated therewith so that very little power is required in the coil in order to cause the magnetic actuator element 3 to be moved.

The body element 1.2 contains a valve member 11 associated with a guide rod 12 having guide fins 13 mounted to slide in a cylindrical bore 14 of the body element 1.2. At its top end, the bore 14 has a chamfer 15 forming a seat for the valve member 11 (see FIG. 2). The valve member 11 comprises a hub 16 on which an O-ring 17 is mounted. In the embodiment of FIGS. 1 and 2, the hub 16 is longer than the diameter of the O-ring 17 so that the O-ring 17 is mounted on the hub 16 with axial clearance enabling the O-ring 17 to slide on the hub, thus providing effective cleaning of the valve member.

The connection between the magnetic actuator element 3 and the valve member 11 is provided by a coupling member 18. In the embodiment shown, the coupling member comprises a C-shaped yoke 19 connected to the magnetic actuator element 3 by a connecting rod 20. The branches of the yoke 19 are disposed on either side of a peg 21 comprising a rod 22 secured to the valve member 11 and a head 23 engaged in the yoke 19. The rod 22 and the head 23 are mounted in the yoke so as to leave radial clearance thus enabling the magnetic actuator element 3 to slide accurately in the body element 1.1 and the valve member 11 to slide accurately in the body element 1.2 without interference, even if the body elements 1.1 and 1.2 are not mounted accurately on the same axis.

The body element 1.3 contains a secondary shutter 24 which is secured to the bottom end of the guide rod 12 of the valve member, e.g. by screw fastening. In this embodiment, the secondary shutter 24 comprises a conical bottom portion 25 that is elongate, extending over a conical constriction 26 of the body element 1.3.

In order to assemble the filler spout while the three body elements 1.1, 1.2, and 1.3 are separate, the secondary shutter 24 is mounted to the bottom end of the guide rod 12 of the valve member, while the valve member is not fitted with its O-ring 17. The hub 16 of the valve member is then engaged in the body element 1.2 until the hub 16 projects therefrom, and the O-ring 17 is put into place. The body element 1.3 is fixed to the body element 1.2. The magnetic actuator element 3 is engaged in the body element 1.1 and then the assembly comprising the valve member 11 is presented initially in offset manner to the body element 1.1 so as to bring the head 23 level with the opening in the yoke 19, and then the body element 1.2 is moved onto the axis of the body element 1.1 so as to engage the head 23 between the branches of the yoke 19. The body elements 1.1 and 1.2 are then assembled together by means of the quick coupling member 2.

When the filler spout is in its closed position as shown in FIG. 1, the O-ring 17 bears against the seat 15 and the secondary shutter 25 extends close to the constriction 26 in the body element 1.3. In this context, it should be observed that the dimensions and the relative positions of the conical portion and of the constriction 26 are designed in such a manner that in the closed position of the valve, as shown, the conical portion 25 of the secondary shutter is spaced apart from the constriction 26 with clearance that is just sufficient to retain substance contained in the body elements 1.2 and 1.3 by capillarity. Furthermore, the magnetic actuator element 3 is offset downwards relative to the coil 6, the yoke 19 bearing against the head 23 of the peg 21. In order to open valve, the coil is powered and the magnetic actuator element 3 is driven upwards, as shown in FIG. 2. In this position, the valve member 11 is open and the secondary shutter 24 is in a position that allows the substance to flow out.

In the embodiment shown in FIGS. 1 and 2, the elongate portion 25 of the secondary shutter 24 cooperates with the constriction 26 of the body element 1.3 to provide a passage which ensures that the flow of substance is maintained under laminar conditions. Such a secondary shutter is useful for packaging a product that tends to foam in the event of turbulent flow, such as milk.

Figure 3:
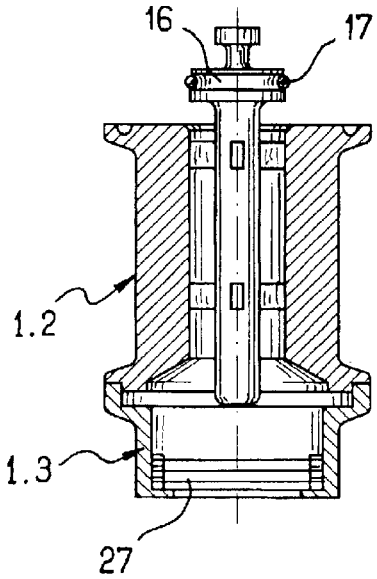
FIG. 3 is a fragmentary view analogous to FIG. 1 showing a variant of the outlet member of the filler spout.

FIG. 3 shows a variant embodiment in which the secondary shutter is omitted and the body element 1.3 merely contains antifoaming grids 27. This embodiment can be used in particular for packaging water. Under such circumstances there is no need for the O-ring 17 of the valve member 11 to be free to move axially, and it is then advantageous to provide a hub 16 having a groove in which the O-ring 17 is prevented from moving.

Figure 4:
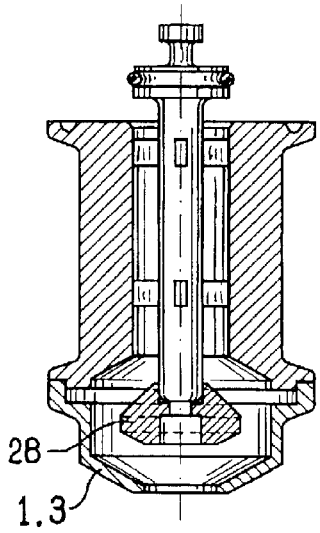
FIG. 4 is a fragmentary section view analogous to that of FIG. 1 showing another variant of the outlet member of the filler spout.

FIG. 4 shows another variant embodiment in which the secondary shutter 28 is of small height, thus enabling the overall size of the resulting assembly to be reduced when it is not necessary to ensure a laminar flow of the substance at the outlet from the spout.

Figure 5:
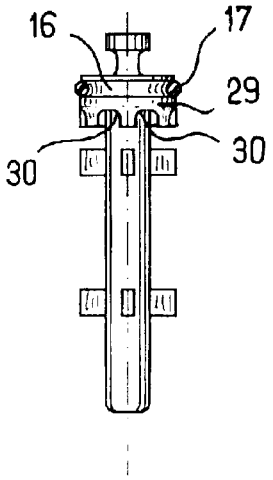
FIG. 5 is a side view of a variant embodiment of the valve member.

FIG. 5 shows a variant embodiment of the valve member in which the hub 16 is provided with a skirt 29 having notches 30 made therein, thus making it possible to ensure that flow rate varies in more progressive manner while the valve member is being opened or closed.

Figure 6:
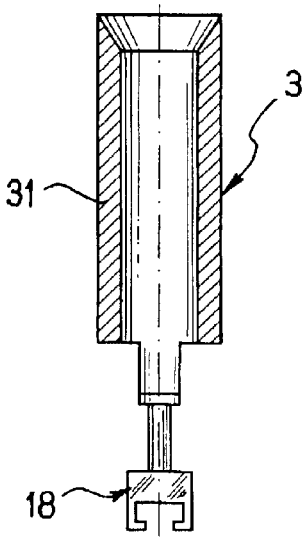
FIG. 6 is an axial section view of a variant embodiment of the magnetic actuator element.

FIG. 6 shows a magnetic actuator element having a tubular core 31. This type of actuator member is preferable for thick substances such as oil or substances containing pulp.

Naturally, the invention is not limited to the embodiment described and variants can be applied thereto without going beyond the ambit of the invention as defined by the claims.

In particular, although the device of the invention is shown having a coupling member comprising a C-shaped yoke associated with a peg, thus making it possible to perform assembly quickly and also to provide effective cleaning without it being necessary to dismantle the device, other coupling members that present radial clearance could also be used, for example a bayonet coupling member.

What is claimed is:

1. A filler spout comprising a tubular body having mounted therein a valve member extending over a valve seat, and a magnetic actuator element associated with a coil outside the body and connected to the valve member by an axial coupling member comprising a C-shaped yoke and a peg having a head separably engaged between branches of the yoke with a radial clearance.

2. A filler spout according to claim 1, wherein the valve member comprises a hub having an O-ring mounted thereon, and wherein the valve seat comprises a chamfer at the top end of a cylindrical body element.

3. A filler spout according to claim 2, wherein the O-ring is mounted on the hub with axial clearance.

4. A filler spout according to claim 2, wherein the hub includes a skirt which extends below the O-ring and having a bottom edge including notches.

5. A filler spout comprising a tubular body having mounted therein a valve member extending over a valve seat, and a magnetic actuator element associated with a coil outside the body and connected to the valve member by an axial coupling member comprising two separable elements coupled together with a radial clearance, and a secondary shutter disposed downstream from the valve member and rigidly connected thereto, the body having a constriction overlying the secondary shutter, the secondary shutter and the constriction being of dimensions and relative positioning that are appropriate to ensure that while the valve member is closed, the secondary shutter leaves a clearance relative to the constriction that is just sufficient to retain a liquid contained in the body between the valve member and the secondary shutter by means of capillarity.

6. A filler spout according to claim 5, wherein the secondary shutter is mounted in a body element separate from the body element containing the valve member, and is connected thereto by a quick coupling member.

* * * * *